United States Patent [19]

Mueller

[11] Patent Number: 4,490,705

[45] Date of Patent: Dec. 25, 1984

[54] ELECTROMAGNETIC RELAY

[75] Inventor: Erwin Mueller, Munich, Fed. Rep. of Germany

[73] Assignee: Siemens Aktiengesellschaft, Berlin & Munich, Fed. Rep. of Germany

[21] Appl. No.: 469,289

[22] Filed: Feb. 24, 1983

[30] Foreign Application Priority Data

Apr. 14, 1982 [DE] Fed. Rep. of Germany ..... 3213737

[51] Int. Cl.[3] ..... H01F 7/14

[52] U.S. Cl. ..... 335/276; 335/270; 335/124; 335/81

[58] Field of Search ..... 335/80, 81, 124, 125, 335/128, 187, 202, 203, 270, 271, 272, 276, 279

[56] References Cited

U.S. PATENT DOCUMENTS

| | | | |
|---|---|---|---|
| 3,079,478 | 2/1963 | Pahud | 335/203 |
| 3,163,805 | 12/1964 | Vash et al. | 335/276 |
| 3,165,676 | 1/1965 | O'Brien | 335/276 |
| 3,517,359 | 6/1970 | Trbovich et al. | 335/279 |
| 3,588,769 | 6/1971 | Buckwalter | 335/279 |
| 3,946,347 | 3/1976 | Sauer | 335/202 |
| 4,058,783 | 11/1977 | Reuting | 335/276 |
| 4,091,346 | 5/1978 | Nishimura et al. | 335/202 |
| 4,339,735 | 7/1982 | Ono et al. | 335/276 |

FOREIGN PATENT DOCUMENTS 1258862 12/1971 United Kingdom .

*Primary Examiner*—E. A. Goldberg
*Assistant Examiner*—George Andrews
*Attorney, Agent, or Firm*—Hill, Van Santen, Steadman & Simpson

[57] ABSTRACT

A relay has a bar-shaped armature which is seated at a location of one coil end over an armature carrier comprised of insulating material. For the purpose of seating, taut bands projecting in a direction of the rotational axis of the armature are integrated on the armature carrier, said taut bands forming suspension heads at their free ends. The armature carrier is engagably secured over said suspension heads between fork-shaped ends of retaining arms integrated on the coil body. Given movement of the armature, the taut bands are twisted so that a friction-free armature bearing is created.

17 Claims, 4 Drawing Figures

ELECTROMAGNETIC RELAY

BACKGROUND OF THE INVENTION

The invention relates to an electromagnetic relay with an elongated armature which extends substantially parallel to the axis of an excitation coil and which is movably seated with one end at a flange of the coil body to an armature carrier consisting of insulating material, particularly according to German patent No. P 31 32 239.5, corresponding to U.S. Ser. No. 401,236 incorporated herein by reference.

The relay according to the above referenced patent has the advantage that, as a result of directly fastening the contact springs to the insulating carrier of the armature, the armature motion is directly transmitted to the contact springs so that no actuation slide is required. Due to the connection of the movable contact springs to the insulating carrier, thus any and all friction between the armature and movable contact spring which would otherwise be caused by the standard actuation slide is avoided. However, all friction is not avoided in the sample embodiments of the parent patent since the knife-edge bearings and trunion mountings of the armature disclosed there cause admittedly slight but not negligible friction.

SUMMARY OF THE INVENTION

An object of the invention is to improve a relay of the type initially described, particularly according to the above referenced patent, such that the armature is seated practically friction-free and with few parts which are easy to assemble.

This object is inventively achieved in that taut bands which are respectively held at retaining arms of the coil body and which proceed toward two sides in the direction of the armature's rotational axis are formed onto the armature carrier comprised of elastic synthetic.

A jolt-protected, simple and friction-free armature seating is obtained by means of the taut bands integrally designed on the armature carrier, whereby the armature and, if need be the movable contact parts secured in the armature carrier can be fixed by means of a plug-in assembly.

In a preferred development of the invention, the retaining arms of the coil body are designed in fork-like fashion, whereby the armature retaining element can be suspended between the fork-like ends of the retaining arms by use of suspension heads formed onto the free ends of the taut bands. The suspension heads can respectively rest in index notches of the retaining arms with lock-in knife edges. It is further expedient that the retaining arms of the coil body, like the armature carrier, are elastically designed.

In a preferred embodiment of the relay, the cross-sectional longitudinal axis of the taut band extends at right angles relative to the longitudinal axis of the armature. As a result of this, the armature carrier can be manufactured in a particularly simple fashion with an injection molding method. By means of changing the cross-sectional longitudinal axis of the taut bands, for example by means of selecting a specific angle between said cross-sectional longitudinal axis and the longitudinal axis of the armature, a single-sided position of armature rest can be provided. The cross-sectional surface of the taut band is preferably rectangular, whereby an exact armature position and a restoring effect into the initial position can be achieved. Accordingly, the ratio of length to width in the cross-section of the taut band is preferably selected between 4:1 and 10:1. By so doing, a sufficient but not too great a torsion spring constant can be achieved.

In a modification, the cross-sectional surface of the taut band can also be designed rhombic or oval. With this as well, an exact preferred direction for the armature position as well as an exact resetting into the initial position can be achieved; however, at the same time, the taut bands are easier to manufacture and can be provided more homogeneously in the injection molding method because of the greater flow cross-section.

DESCRIPTION OF THE PREFERRED EMBODIMENTS

Figure 1:
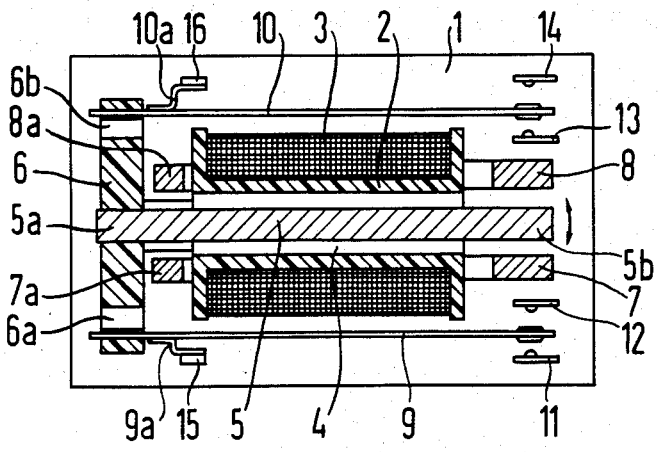
FIG. 1 is an electro-magnetic relay illustrated in a section as seen from the top and in a schematic illustration.

In plan view, FIG. 1 shows the sectional illustration of a relay having the fundamental structure according to the above described patent. Secured to a base body 1 is a coil supporting body 2 with a coil winding 3. An elongated, bar-shaped armature 5 is disposed in the axial bore 4 of the coil supporting body 2. With its end **5*a*, said armature is seated in an armature carrier 6 and its free end 5*b* can be moved between the pole plates 7 and 8 with which it forms respective working air gaps. The pole plates 7 and 8 form magnet yokes next to or, respectively, below the coil. The ends 7*a* or, respectively, 8*a*** of the magnet yokes are coupled to the seated end of the armature. A permanent magnet (not illustrated) can, for example, be disposed between these yokes, whereby a polarized magnet system results.

The armature carrier 6 is connected to the armature end **5*a* by means of plug-in assembly. Moreover, it also carries inserted center contact springs 9 and 10 in recesses 6*a*, or respectively 6*b*, said center contact springs 9 and 10 respectively extending parallel to the armature at both sides of the coil and their free ends respectively cooperating with cooperating contact elements 11, 12, 13 and 14. The center contact springs 9 and 10 anchored in the insulating carrier 6 are connected over elastic transition pieces 9*a*, or respectively 10*a*, to the corresponding terminal lugs 15 and 16** which are anchored in the base body.

Figure 2:
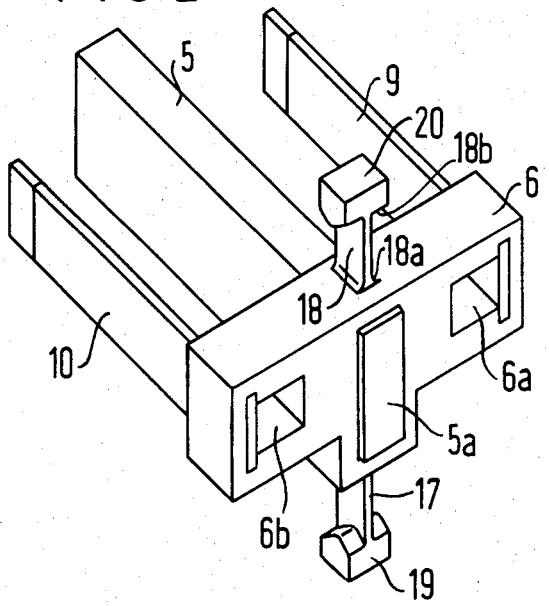
FIG. 2 illustrates an armature with the armature retaining element.

FIG. 2 shows the design of the armature carrier in detail. As mentioned, the armature carrier 6 carries the bar-shaped armature 5 as well as the center contact springs 9 and 10 which are respectively secured in recesses of the carrier by means of being plugged in. Integrated on the armature carrier are two taut bands 17 and 18 which respectively extend at the upper side and at the under side of the armature carrier 6 in the direction of the armature's rotational axis and which carry respective suspension heads 19, or respectively 20, at their free ends. The taut bands 17 and 18 serve as torsion stays which can twist given movement of the armature without bearing friction occurring. The taut bands exhibit an essentially rectangular cross-sectional surface, and the longitudinal axis of the cross-sectional surface is therefore provided parallel to the longitudinal axis of the armature. A precise alignment of the inserted armature thereby results. In a modification which is not illustrated, the cross-sectional longitudinal axis of the taut bands 17 and 18 could also be disposed at an angle relative to the longitudinal axis of the armature in order to provide a bias of the armature toward the one or to the other side and thus to provide a single-sided position of armature rest. The transition locations 18*a* and 18*b* from the taut band 18 to the armature carrier 6 as well as at the suspension head 20 are rounded off just like the transition locations at the taut band 17 in order, on the one hand to achieve a homogeneous out-flow in the injection process of the armature carrier and, on the other hand, in order to avoid a notch effect given employment in the relay.

Figure 3:
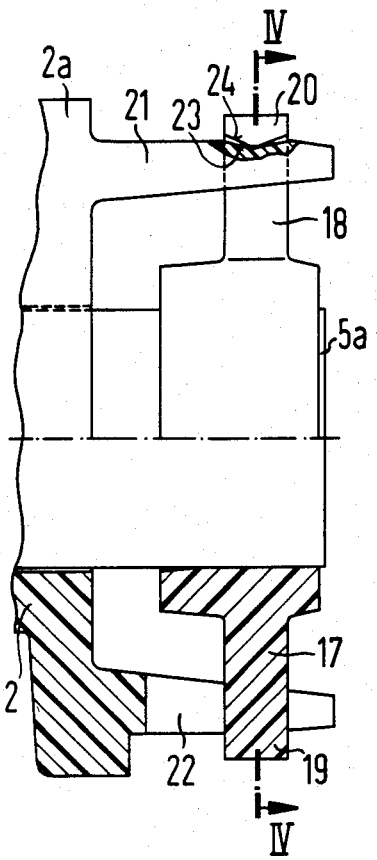
FIGS. 3 and 4 illustrate the armature bearing at the coil body in two partially cut views.
Figure 4:
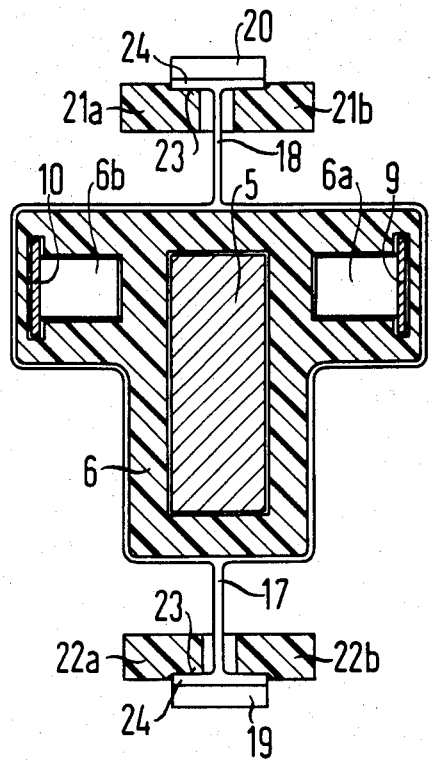

FIGS. 3 and 4 show the fixing of the armature over the armature carrier 6 on the coil body 2. For the purpose of fastening the armature, the coil body 2 exhibits respective retaining arms 21 or, respectively, 22 at its flange 2*a* above and below the armature end 5*a* said retaining arms 21 or, respectively, 22 having ends 21*a*, 21*b*, 22*a* and 22*b* split in fork-like fashion. A respective index notch 23 is provided at said retaining arms 21 and 22, the suspension heads 19 and 20 engaging into said index notches with respectively one lock-in knife edge 24, and thus are held. The taut bands are therefore respectively inserted between the fork ends 21*a* and 21*b* or 22*a* and 22*b*, respectively. The lock-in knife edges are symmetrically inclined in roof-like fashion so that the taut bands center themselves in a lateral direction.

The armature carrier 6 with the integrated taut bands 17 and 18 as well as the suspension heads 19 and 20 preferably consist of tough-elastic, tear-proof, and temperature-stable synthetic having a slight elastic after-effect. A reliable tension effect thereby results over the entire operating temperature range of the relay, and a high mechanical useful life is therefore provided. Coming into consideration, for example, as an appropriate material is PBTP. It is also expedient to employ the same material for the coil body with the integrated retaining arms 21 and 22. With such materials, a temperature compensation as well as a compensation of material influences, for example contractions, is provided for.

In a modification of the sample embodiment, of course, the armature suspension can also be attached to the coil laterally so that the armature would not extend in the inside of the coil but, rather, laterally next to the coil. Given a corresponding modification, the retaining arms for the armature carrier could then be laterally integrated on the coil body, whereas the remaining parts, the fastening or, respectively, actuation of the contact spring would have to be correspondingly modified. The friction-free bearing of the armature via taut bands could, in this case, ensue precisely as in the illustrated sample embodiment.

Although various changes and modifications might be proposed by those skilled in the art, it will be understood that I wish to include within the claims of the patent warranted hereon all such changes and modifications as reasonably come within my contribution to the art.

I claim as my invention:

1. An electro-magnetic relay, comprising: an elongated armature which extends substantially parallel to an axis of an excitation coil of the relay and which is movably coupled at one end via an insulated armature carrier to a flange of a coil supporting body supporting the coil; an electrical contact element mounted on said armature carrier, said contact element cooperating with another contact element associated with the relay; two taut bands projecting from the armature carrier at two opposite sides thereof along a rotational axis of the armature; said taut bands permitting relatively friction-free rotation of the armature and armature carrier, said taut bands being respectively held at retaining arms of the coil body; ends of the retaining arms of the coil body being designed in fork-like fashion; and the armature carrier being suspended under tensile stress between the fork-line ends of the retaining arms by use of suspension heads on free ends of the taut bands.

2. A relay according to claim 1 wherein the suspension heads respectively rest in index notches of the retaining arms by means of lock-in knife edges.

3. A relay according to claim 1 wherein the retaining arms of the coil body are elastically designed.

4. A relay according to claim 1 wherein the armature extends into an aperture of the coil in an axial direction and the retaining arms for the armature carrier are centrally disposed and extend from the coil flange.

5. A relay according to claim 1 wherein the armature extends next to the coil and the retaining arms for the armature carrier project laterally from the coil flange.

6. A relay according to claim 1 wherein the longitudinal axis of the taut bands is perpendicular to the longitudinal axis of the armature.

7. A relay according to claim 1 wherein a cross-sectional surface of the taut bands perpendicular to their longitudinal extent has a rectangular shape.

8. A relay according to claim 1 wherein a cross-sectional surface of the taut bands perpendicular to their longitudinal extent has an oval shape.

9. A relay according to claim 1 wherein the armature carrier and the coil body are comprised of a tough-elastic synthetic.

10. A relay according to claim 9 wherein the armature carrier and coil body are comprised of the same synthetic material.

11. An electro-magnetic relay, comprising: an elongated armature connected to an armature carrier carrying a first contact element; an excitation coil of the relay in association with a coil supporting body; the armature being positioned in association with the coil such that when the coil is excited the armature moves causing a slight rotation of the armature carrier; a second contact element in association with the first contact element such that when the armature carrier rotates slightly the two contact elements can make or break an electrical contact; band means rotationally coupling the armature carrier to the coil body such that when the armature carrier rotates the band means provides minimal torsional rotational resistance; and the band means comprising first and second taut bands projecting outwardly from and at opposite sides of the armature carrier, said band means being coupled to the coil body by respective projections of the coil body.

12. A relay according to claim 11 wherein the two taut bands extend longitudinally in a direction perpendicular to a longitudinal extend of the armature.

13. A relay according to claim 12 wherein the armature longitudinal extent is parallel to a coil axis of the coil.

14. A relay according to claim 13 wherein a longitudinal extent of the armature is perpendicular to a major surface of the armature carrier and the first contact element has a longitudinal extend substantially parallel to the armature.

15. A relay according to claim 11 wherein the band means are comprised of an elastic material permitting a relatively small twisting action of the band means with minimal torsional rotational resistance being caused by the band means.

16. An electro-magnetic relay, comprising: an elongated armature which extends substantially parallel to a winding axis of an excitation coil of the relay and which is movably coupled at one end via an armature carrier to a flange of a coil supporting body of the coil; torsion connecting means projecting from the armature carrier to the flange so as to permit a relatively friction-free rotation of the armature and armature carrier when the armature is magnetically influenced by the excitation coil; and the armature carrier, torsion means, and flange being integral with one another and of the same material.

17. A relay according to claim 16 wherein the torsion comprises first and second taut bands.

* * * * *